US006035588A

United States Patent [19]

Zehner et al.

[11] Patent Number: 6,035,588

[45] Date of Patent: Mar. 14, 2000

[54] DECK PLANK

[75] Inventors: Burch E. Zehner, Pataskala; A. Anthony Groh, Columbus; Philip H. Stobart, Worthington, all of Ohio

[73] Assignee: Crane Plastics Company Limited Partnership, Columbus, Ohio

[21] Appl. No.: 09/162,626

[22] Filed: Sep. 29, 1998

Related U.S. Application Data

[63] Continuation-in-part of application No. 09/009,283, Jan. 20, 1998, which is a continuation-in-part of application No. 08/752,813, Nov. 21, 1996, Pat. No. 5,836,128.

[51] Int. Cl.[7] ..... E04B 5/43

[52] U.S. Cl. ..... 52/98; 52/314; 52/573.1; 52/592.1; 52/650.3; 52/745.05; 52/775; 403/41

[58] Field of Search ..... 52/98, 100, 177, 52/309.1, 314, 483.1, 573.1, 578, 580, 581, 592.1, 604, 605, 650.3, 731.7, 745.05, 745.06, 745.13, 747.1, 764, 765, 775, 780, DIG. 7; 403/28, 41

[56] References Cited

U.S. PATENT DOCUMENTS

| | | | |
|---|---|---|---|
| 329,616 | 11/1885 | Baldwin . | |
| 502,289 | 8/1893 | Feldmann . | |
| 1,374,082 | 1/1921 | Hedges . | |
| 1,433,896 | 10/1922 | Lord . | |
| 1,551,544 | 9/1925 | Crooks . | |
| 1,952,536 | 3/1934 | Crooks . | |
| 2,186,684 | 1/1940 | Ritter . | |
| 2,947,040 | 8/1960 | Schultz . | |
| 3,386,221 | 6/1968 | Giovannucci . | |
| 3,987,599 | 10/1976 | Hines | 52/591.1 |
| 4,095,913 | 6/1978 | Pettersson et al. | 52/592.4 X |
| 4,241,133 | 12/1980 | Lund et al. . | |
| 4,337,607 | 7/1982 | Boschetti | 52/573.1 |
| 4,376,144 | 3/1983 | Goettler . | |
| 4,526,418 | 7/1985 | Martin . | |
| 4,807,416 | 2/1989 | Parasin | 52/573.1 X |
| 5,033,147 | 7/1991 | Svensson . | |
| 5,351,915 | 10/1994 | Aandalen . | |
| 5,410,855 | 5/1995 | Clausen et al. . | |
| 5,411,782 | 5/1995 | Jarvis et al. . | |
| 5,516,472 | 5/1996 | Laver . | |
| 5,647,184 | 7/1997 | Davis | 52/100 X |
| 5,836,128 | 11/1998 | Groh et al. | 52/580 |

FOREIGN PATENT DOCUMENTS

| | | |
|---|---|---|
| 93306843 | 8/1993 | European Pat. Off. . |
| 93306845 | 8/1993 | European Pat. Off. . |

*Primary Examiner*—Carl D. Friedman
*Assistant Examiner*—Kevin D. Wilkens
*Attorney, Agent, or Firm*—Standley & Gilcrest LLP

[57] ABSTRACT

A deck plank comprised of a wood replacement material. The deck plank includes a top surface, a first leg, and a second leg. The top surface has a first end portion and a second end portion. The first leg is attached to the first end portion, and the second leg is attached to the second end portion. The first leg extends downward from the top surface, and it has a tongue and an outer surface. The tongue has a first limb and a second limb which are joined together to define a recess. The outer surface defines a channel that extends along the tongue. The second leg also extends downward from the top surface, and it has an upper portion and a lower portion. The upper portion and the lower portion define a groove, and the tongue is adapted to fit with a groove of an adjacent, substantially similar deck plank. When the tongue of the deck plank is placed in the groove of an adjacent deck plank, the channel of the deck plank is adapted to induce one of the limbs to fracture, if necessary, in response to expansion of the wood replacement material so that the joint between adjacent deck planks does not buckle.

46 Claims, 7 Drawing Sheets

DECK PLANK

This is a continuation-in-part of U.S. application No. 09/009,283, filed Jan. 20, 1998. U.S. application No. 09/009,283 is a continuation-in-part of U.S. application No. 08/752,813, filed Nov. 21, 1996, now U.S. Pat. No. 5,836,128, issued Nov. 17,1988.

BACKGROUND AND SUMMARY OF THE INVENTION

The present invention relates generally to decks and, more particularly, to a deck plank that has a tongue and a groove.

Wood is commonly used for decks. However, the use of wood for decks presents a number of problems. First, constant exposure to the elements can cause the wood to deteriorate over time. In order to prevent (or delay) this from happening, the wood must be treated with a wood preservative. Treating the wood can be a time consuming and messy process. Next, wood is frequently stained or painted to achieve a desired color, but the color can fade, chip, and peel over time.

In addition, the dimensions of wood vary depending on the moisture content of the wood and the temperature. These variations can cause warping of the boards which can cause the surface of the deck to become uneven over time. Finally, when a tongue and groove arrangement of boards is used, if the head of the nail is not flush with the surface of the board, the next board will not fit against it properly, resulting in an uneven surface.

Synthetic wood compositions have been advanced as a substitute for natural wood. Synthetic wood compositions may offer improved durability and enhanced moisture resistance over natural wood. Nevertheless, synthetic wood compositions may still expand and contract as a result of temperature and moisture variations. Consequently, a deck made from synthetic wood deck planks may also become uneven due to expansion and contraction of the synthetic wood material.

Therefore, it would be desirable to have an improved tongue and groove joint. It would also be desirable to have a deck plank having improved dimensional stability and decreased maintenance. The deck plank should be easy to install. The design of the deck plank should ensure that the deck will be smooth and even when installed. In particular, the tongue and groove of the deck plank should compensate for expansion and contraction of the material of the deck plank.

The present invention satisfies some or all of these needs. The present invention provides a deck plank that is preferably comprised of a wood replacement material. The deck plank has a tongue that includes a sacrificial limb. The sacrificial limb is adapted to fracture, if necessary, in response to expansion of the material of the deck plank to limit vertical displacement of the top surface of the deck plank. The present invention also provides a deck and a method of making a deck.

A preferred embodiment of a deck plank of the present invention includes a top surface, a first leg, and a second leg. The top surface may be substantially flat and horizontal. The top surface has a first end portion and a second end portion. The first leg is attached to the first end portion, and the second leg is attached to the second end portion. The first leg and the second leg may form at least one open area beneath the top surface. The first leg extends downward from the top surface, and it has a tongue and an outer surface. The tongue has a first limb and a second limb which are joined together to define a recess that preferably extends the length of the deck plank. The outer surface defines a channel that extends along the tongue. The channel preferably extends the length of the tongue. The second leg also extends downward from the top surface, and it has an upper portion and a lower portion. The upper portion and the lower portion define a groove, and the tongue is adapted to fit with a groove of an adjacent, substantially similar deck plank. When the tongue of the deck plank is placed in the groove of an adjacent deck plank, the channel of the deck plank is adapted to induce one of the limbs to fracture, if necessary, in response to expansion of the material of the deck plank so that vertical displacement of the top surface is limited.

Many different shapes for the first leg and groove design may be used, including curves and various complex shapes. The first leg and the second leg of the deck plank are preferably adapted to maintain a gap between a portion of the first leg of the deck plank and a portion of the second leg of an adjacent deck plank when an outer portion of the tongue of the deck plank is placed adjacent to an inner portion of the groove of the adjacent deck plank. For example, the first leg may have an angled portion of a first angle and the second leg may have an angled portion of a second angle. The first angle may be sufficiently different from the second angle such that the first leg and the second leg are adapted to maintain a gap between the angled portion of the first leg of the deck plank and the angled portion of the second leg of the adjacent deck plank when an outer portion of the tongue of the deck plank is placed adjacent to an inner portion of the groove of the adjacent deck plank. The first angle may be greater or less than the second angle. It is preferred that the outer portion of the tongue and the inner portion of the groove are substantially vertical.

In addition, the first leg may have an upper portion above the tongue, and the second leg may have an upper portion above the groove. The upper portion of the first leg and the upper portion of the second leg may be adapted to maintain a gap between the upper portion of the first leg of the deck plank and the upper portion of the second leg of an adjacent deck plank when an outer portion of the tongue of the deck plank is placed adjacent to an inner portion of the groove of the adjacent deck plank.

The deck plank may include at least one other leg attached to and extending downward from the top surface at a point intermediate between the first and second end portions. The top surface of the deck plank may include a channel extending the length of the deck plank to provide an escape path for water that comes into contact with the top surface. The tongue may include a vertical cutout that preferably allows water to escape through a joint between adjacent deck planks.

A deck plank may be attached to a support structure with at least one fastener such as a nail. A fastener preferably extends through the lower portion of the second leg of the deck plank. Those skilled in the art should also recognize that a deck plank of the present invention may be installed by other conventional means such as screws, bolts, and adhesives.

The deck plank may be made from wood, plastics, or from several other materials including conventional wood replacement materials such as synthetic wood compositions. However, it is believed that the present invention is unique apart from material considerations. The wood replacement material may be comprised of a polymer, such as homopolymers and copolymers of polyethylene, polyvinyl chloride, polypropylene and ABS, or a mixture of these polymers. The wood replacement material also preferably includes cellulose material for appearance, stiffness, and economics. The cellulose material may be in the form of fibers (e.g., wood flour and the like). Table 1 shows an example formulation of a wood replacement material. The deck planks made from wood replacement materials are preferably extruded using conventional plastics extrusion equipment and one or more dies to provide the desired cross section shape of each plank.

TABLE 1

| | |
|---|---|
| Wood Flour | 50% (by weight) |
| HDPE | 45% (by weight) |
| Zinc Stearate | 2.5% (by weight) |
| Wax | 2.5% (by weight) |

The present invention also includes a deck. The deck may include a support structure and at least one deck plank. The at least one deck plank is attached to the support structure. The deck also preferably includes a starter strip that is attached to the support structure. The starter strip may be made from a wood replacement material. The starter strip may have a groove that is adapted to receive the tongue of the deck plank.

The starter strip may have a leg that defines a groove. The leg of the starter strip may be shaped so that a gap is maintained between a portion of the first leg of the deck plank and a portion of the leg of the starter strip when an outer portion of the tongue of the deck plank is placed adjacent to an inner portion of the groove of the starter strip. For example, the leg of the starter strip may have an angled portion of a third angle. The first angle of a deck plank may be sufficiently different from the third angle of the starter strip so that a gap is maintained between the angled portion of the first leg of the deck plank and the angled portion of the starter strip when an outer portion of the tongue of the deck plank is placed adjacent to an inner portion of the groove of the starter strip. The first angle of the deck plank may be greater or less than the third angle of the starter strip.

The present invention also includes a method of making a deck. A preferred method includes providing a support structure, providing a first deck plank, and attaching the first deck plank to the support structure. The method may further include providing a second deck plank, placing the tongue of the second deck plank adjacent to the groove of the first deck plank, and attaching the second deck plank to the support structure. In such an embodiment, a channel of the second deck plank is adapted to induce one of the limbs of the second deck plank to fracture, if necessary, in response to expansion of the material of the deck planks so that vertical displacement of the top surface of the second deck plank is limited.

Another method of the present invention includes providing a support structure, providing a starter strip, attaching the starter strip to the support structure, providing a first deck plank, placing the tongue of the first deck plank adjacent to the groove of the starter strip, and attaching the first deck plank to the support structure.

In addition to the novel features and advantages mentioned above, other objects and advantages of the present invention will be readily apparent from the following descriptions of the drawings and preferred embodiments.

DETAILED DESCRIPTION OF PREFERRED EMBODIMENT(S)

The present invention is directed to a deck plank that includes a tongue and a groove. The deck plank is preferably comprised of a wood replacement material. The tongue of the deck plank includes a sacrificial limb. The sacrificial limb is adapted to fracture, if necessary, in response to expansion of the material of the deck plank to limit vertical displacement of the top surface of the deck plank. The present invention also provides a deck and a method of making a deck.

Figure 1:
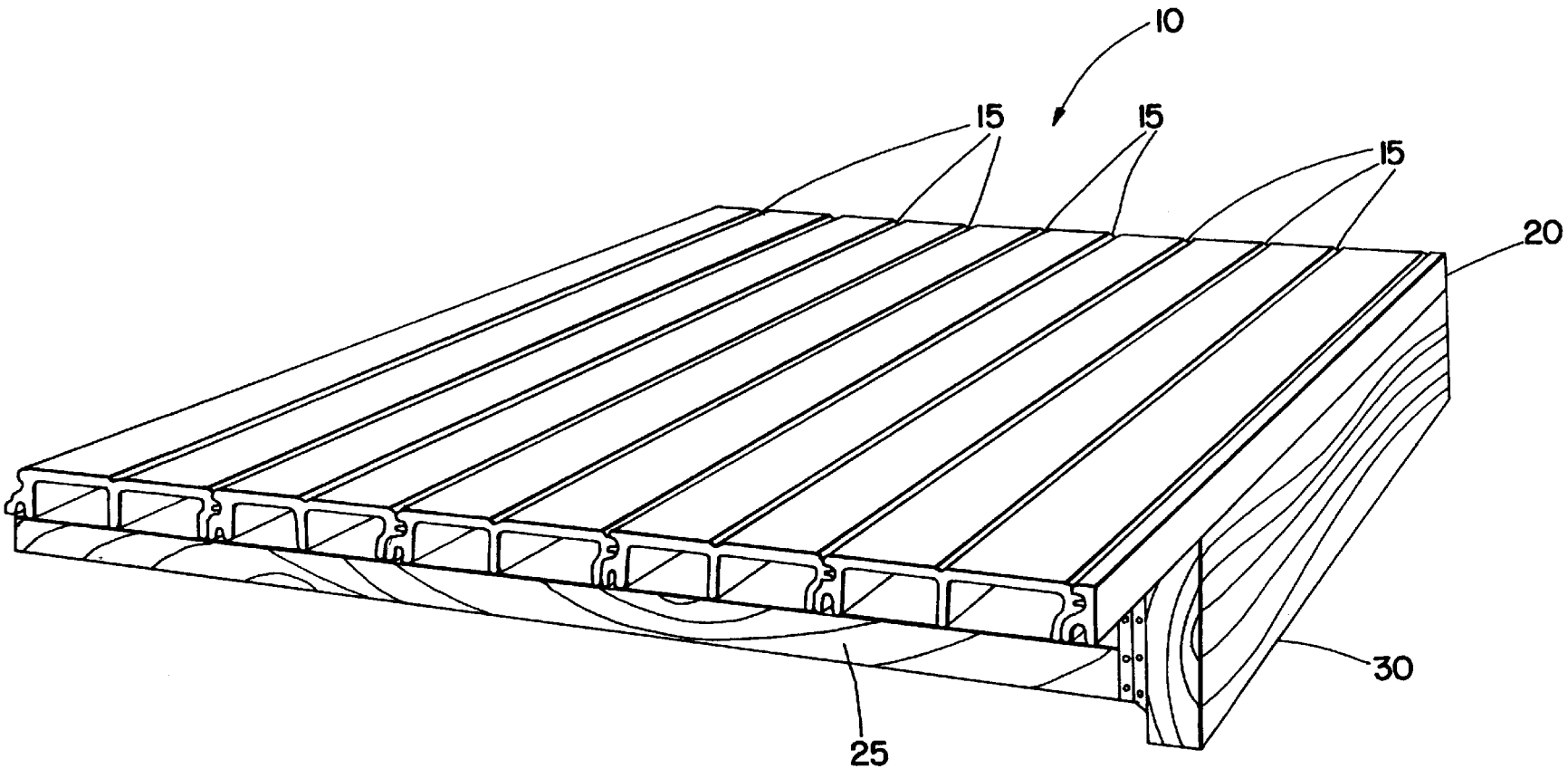
FIG. 1 is a partial perspective view of one embodiment of a deck of the present invention.

Preferred embodiments of the present invention will now be described with reference to the figures. FIG. 1 generally shows a preferred embodiment of a deck 10 of the present invention. The deck 10 is comprised of a series of deck planks 15 and a starter strip 20. The deck 10 may be supported by a support structure. In this example, the support structure includes a ledger 30 and joists 25 (only one shown) perpendicular to the ledger 30.

Figure 2:
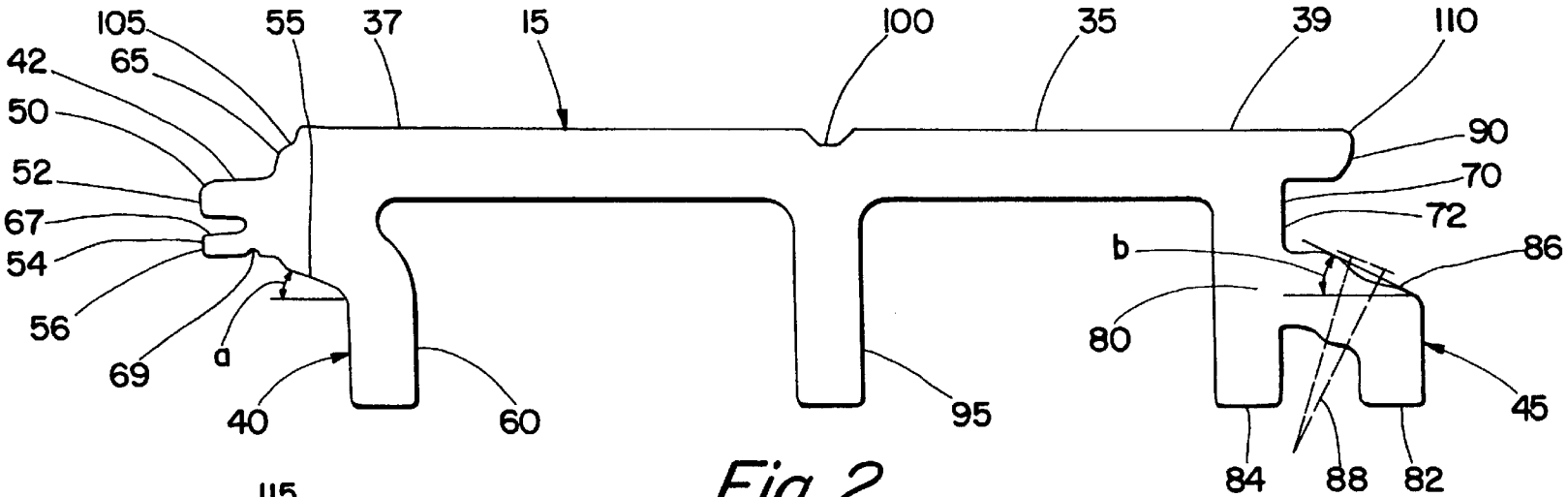
FIG. 2 is a cross sectional view of a preferred embodiment of a deck plank of the present invention.

A preferred embodiment of a deck plank 15 is shown in more detail in FIG. 2. The deck plank 15 has a horizontal top surface 35. The top surface 35 of the deck plank, for example, may be approximately 0.375 inches thick. The top surface 35 may be roughened to provide better traction or to simulate the appearance of natural wood. The deck plank 15 may be made in many lengths including a variety of standard lengths, e.g. 8, 10, and 12 foot lengths. The weight of the deck plank 15 may be greatly reduced as compared to a solid plank due to the material reduction.

A leg 40 is attached to one end portion 37 of the deck plank 15, and a leg 45 is attached to the opposite end portion 39 of the deck plank 15. The leg 40 may include a tongue 50, an angled portion 55, a lower portion 60, and an upper portion 65. The angled portion 55 extends from the lower portion 60 to the tongue 50. The angle "a" of the angled portion 55 is measured relative to horizontal. The angle "a" is preferably approximately 25°.

It is preferred that the outer portion 56 of the tongue 50 has a substantially vertical edge. In addition, the tongue 50 has a limb 52 and a limb 54. The limb 52 and the limb 54 define a recess 67. The recess 67 is adapted to allow each of the limbs 52, 54 to flex in response to a sufficient amount of pressure. As a result, the recess 67 preferably allows for some expansion and contraction of the material of the deck plank 15 when the tongue of the deck plank 15 is placed in a groove of an adjacent deck plank.

The outer surface 42 of the leg 40 defines a channel 69. At least a portion of the channel 69 extends along the tongue 50. It is preferred that the channel 69 extends along the tongue 50 for the length of the deck plank 15. In this example, the channel 69 extends along an edge of the limb 54. In another preferred embodiment, the channel 69 may extend along an edge of the limb 52. It should also be recognized that one channel 69 may extend along an edge of one of the limbs 52, 54 while another channel 69 extends along an edge of the other limb 52, 54.

If necessary, the channel 69 is adapted to further compensate for expansion and contraction of the material of the deck plank 15. When the tongue 50 of the deck plank 15 is placed in a groove of an adjacent deck plank, the channel 69 is adapted to induce the limb along which it extends to fracture, if necessary, in response to expansion of the material of the deck planks so that vertical displacement of the top surface 35 of the deck plank 15 is limited. In other words, the channel 69 preferably allows the limb along which it extends to adjust to expansion of the deck material so that the joint between adjacent deck planks does not cause the surface of the deck to become uneven.

The leg 45 has a lower portion 80 and an upper portion 90. The lower portion 80 and the upper portion 90 define a groove 70. The groove 70 is adapted to receive the tongue of an adjacent, substantially similar deck peck. The inner portion 72 of the groove 70 preferably has a substantially vertical edge.

The lower portion 80 may include a first lower portion 82, a second lower portion 84, and an angled portion 86. The angled portion 86 extends from the first lower portion 82 to about the inner portion 72 of the groove 70. The angle "b" of the angled portion 86 is measured relative to horizontal. The angle "b" of the leg 45 is preferably more than the angle "a" of the tongue, and preferably is approximately 28°. The inner portion 72 may extend substantially vertically upward from the end of the angled portion 86 to the upper portion 90. The first lower portion 82, the second lower portion 84, the angled portion 86, and the inner portion 72 preferably form a generally "h" shape. A fastener 88 may be installed at the angled portion 86 to penetrate the first lower portion 82 and an underlying structure member 25 to thereby secure the deck plank 15 to the support structure.

The deck plank 15 preferably has a vertical support leg 95. The vertical support leg 95 may extend downward perpendicularly from the top surface 35 of the deck plank 15. The vertical support leg 95 provides support for the top surface 35 of the deck plank. Above the vertical support leg 95 may be a channel 100 in the top surface 35 which may extend the length of the deck plank.

A partial notch 105 may be formed in the upper portion 65 of the leg 40. The upper portion 90 of the leg 45 may have a complementary portion 110 to a notch 105. When two deck planks are put together, the partial notch 105 of one deck plank may be mated with the complementary portion 110 of the second deck plank to form a complete notch.

Figure 3:
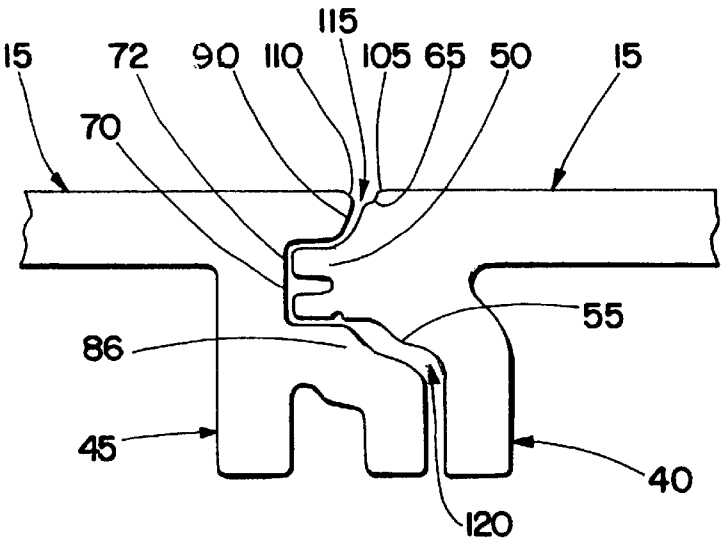
FIG. 3 is a partial cross sectional view of a tongue and groove joint between deck planks of one embodiment of the present invention.

FIG. 3 shows a joint between two deck planks. The leg 40 of one deck plank is mated with the leg 45 of an adjacent plank. The tongue 50 of the leg 40 is positioned adjacent to the inner portion 72 of the groove 70. The upper portion 90 of the leg 45 is adjacent to the upper portion 65 of the leg 40. The partial notch 105 of the upper portion 65 of the leg 40 and the complementary portion 110 of the upper portion 90 of the leg 45 form a complete notch.

There is preferably a gap 115 between the upper portion 65 of the leg 40 and the upper portion 90 of the leg 45 of the adjacent plank below the partial notch 105 and the complementary portion 110. Water which flows into the notch may continue downward into the gap 115. From there, the water may flow along the gap 115 to vertical cutouts in the tongue 50 of the plank (not shown in FIG. 3). The water may then flow down through the vertical cutouts and out the bottom of the plank through the space 120. The space 120 is maintained between the angled portion 55 of the leg 40 and the angled portion 86 of the leg 45 due to the difference between the angles a and b.

A deck plank 15 may be made in different widths, e.g. 6 inch and 12 inch widths, and may have different numbers of channels 100. The channels 100 in the top surface 35 may provide the deck plank 15 with the look of a series of smaller boards. For instance, if the deck plank 15 is approximately 6 inches in width with one channel 100, it may appear to be two 3 inch boards. A 12 inch deck plank 15 with three channels 100 may appear to be four boards of about 3 inches each. However, rather than having to nail four boards per foot of decking, the 6 inch deck plank 15 may only require two nails per foot, while the 12 inch deck plank 15 may only require one nail.

Figure 4:
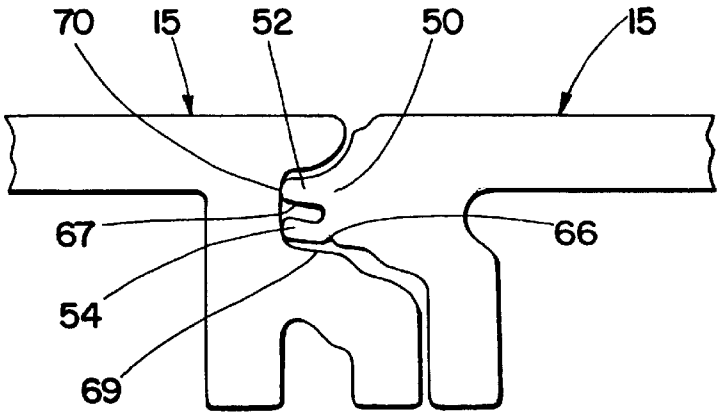
FIG. 4 is a partial cross sectional view of the tongue and groove joint of FIG. 3 after expansion of the deck material has caused one of the limbs of the tongue to fracture.

FIG. 4 is an example of how a tongue 50 may compensate for expansion of the material of adjacent deck planks 15 so that the effect on the top surface of a deck is limited. The deck planks 15 may move horizontally as a result of expansion. The recess 67 allows the limb 54 to compress upward as the tongue 50 moves deeper into the groove 70. As the expanding material continues to exert pressure on the limb 54, the channel 69 may induce a fracture 66 of the limb 54. The fracture 66 allows the limb 54 to compress further upward so that the tongue 50 does not back out of the groove 70. As a result, the joint between the deck planks 15 preferably does not buckle, and vertical displacement of the deck planks 15 is limited.

Figure 5:
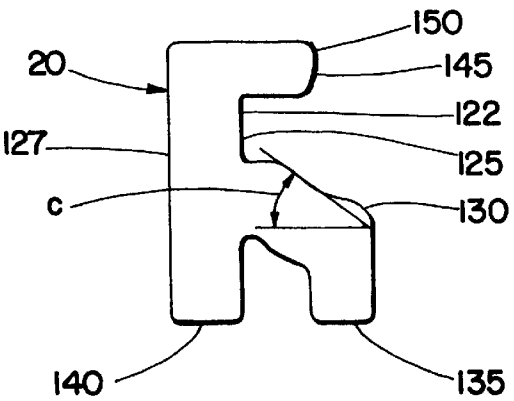
FIG. 5 is a cross sectional view of a preferred embodiment of a starter strip of the present invention.

An example of a starter strip 20 is shown in FIG. 5. The starter strip 20 has a groove 122. The groove 122 is adapted to receive the tongue 50 of a deck plank 15. An inner portion 125 of the groove 122 preferably has a substantially vertical edge.

A starter strip 20 may be comprised of a leg 127 that is shaped similarly to a leg 45 of a deck plank 15. Accordingly, a starter strip 20 may further include an angled portion 130, a first lower portion 135, a second lower portion 140, and an upper portion 145. The upper portion 145 may have a complementary portion 150 of a notch. The angle "c" of the angled portion 130 is measured relative to horizontal. The angle "c" is preferably about the same as angle "b".

Figure 6:
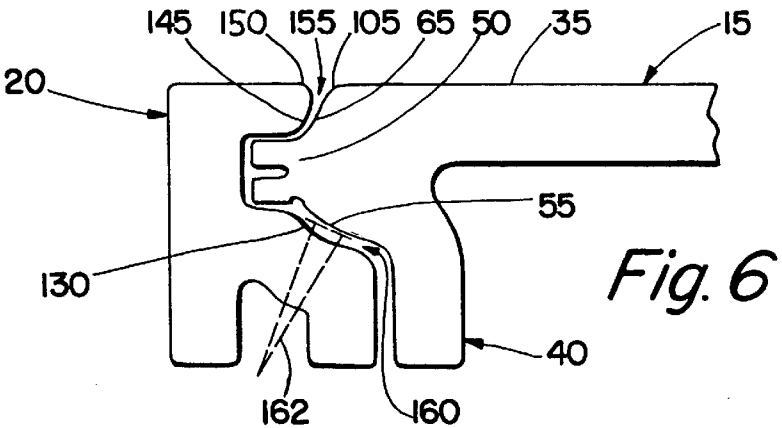
FIG. 6 is a partial cross sectional view of a tongue and groove joint between a deck plank and a starter strip of one embodiment of the present invention.

An example of a joint between a starter strip 20 and a deck plank 15 is shown in FIG. 6. The leg 40 of the deck plank 15 is mated with the starter strip 20. The tongue 50 of the leg 40 is positioned adjacent to the inner portion 125 of the starter strip 20. The upper portion 145 of the starter strip 20 is adjacent to the upper portion 65 of the leg 40. The partial notch 105 of the upper portion 65 of the leg 40 and the complementary portion 150 of the upper portion 145 of the starter strip 20 may form a complete notch. There may be a gap 155 between the upper portion 65 of the leg 40 and the upper portion 145 of the starter strip 20 below the partial notch 105 and the complementary portion 150. A space 160 may be maintained between the angled portion 55 of the leg 40 and the angled portion 130 of the starter strip 20 due to the difference between the angles "a" and "c". A fastener 162 may be installed to penetrate the starter strip 20 and secure it to an underlying structure member. In addition, it should be recognized that the tongue 50 may compensate for expansion of the material of the starter strip 20 and the deck plank 15 in a manner similar to the one previously discussed with reference to FIG. 4.

Figure 7:
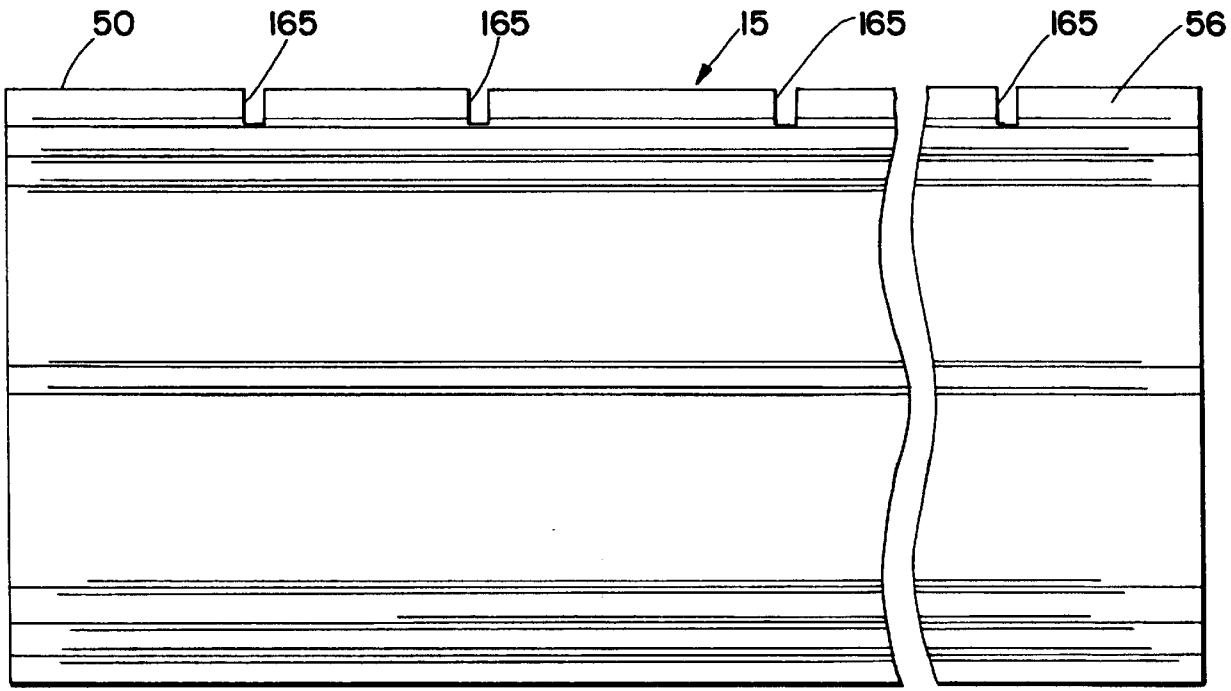
FIG. 7 is a top plan view of a preferred embodiment of a deck plank of the present invention.

FIG. 7 shows a top plan view of a preferred embodiment of a deck plank 15. The deck plank 15 may have a series of vertical cutouts 165 in the leg 40. The vertical cutouts 165 may extend through the outer portion 56 of the tongue 50. The vertical cutouts 165 may be placed at different locations along the length of the plank 15, for example, every twelve inches. Water which flows into the joint between the tongue of one plank and the groove of the next may flow downward through the vertical cutouts 165 and out through the gap 120 between adjacent planks 15. The combination of the gap 115 (and 155), the vertical cutouts 165, and the space 120 (and 160) helps to reduce the buildup of water on the surface of the deck.

A deck of the present invention may be made in the following manner. The starter strip 20 may be nailed, screwed, stapled or otherwise attached to the ledger 30 at intervals along its length. The nails (or other attachments) 162 preferably extend through the angled portion 130 of the starter strip 20 into the ledger 30. A deck plank 15 may then be placed next to the starter strip 20. The tongue 50 of the deck plank may be positioned adjacent to the inner portion 125 of the starter strip 20. The space 160 between the angled portion 130 of the starter strip 20 and the angled portion 55 of the leg 40 preferably allows room for nails 162 which are not flush with the surface of the angled portion 130. This provides a smooth, even fit between the starter strip 20 and the deck plank 15 even if the head of the fastener 162 extends upward slightly from the surface of the angled portion 130.

The deck plank 15 may then be fastened to the joists 25 along its length. The deck plank 15 may be nailed, or otherwise fastened, through the angled portion 86 of the leg 45. A second deck plank 15 may then be placed into position, and the process repeated. The space 120 between the angled portion 86 of the leg 45 of the first deck plank 15 and the angled portion 55 of the leg 40 of the second deck plank 15 again preferably allows room for the head of nails or other fasteners which may extend upward slightly from the surface of the angled portion 86.

Figure 8:
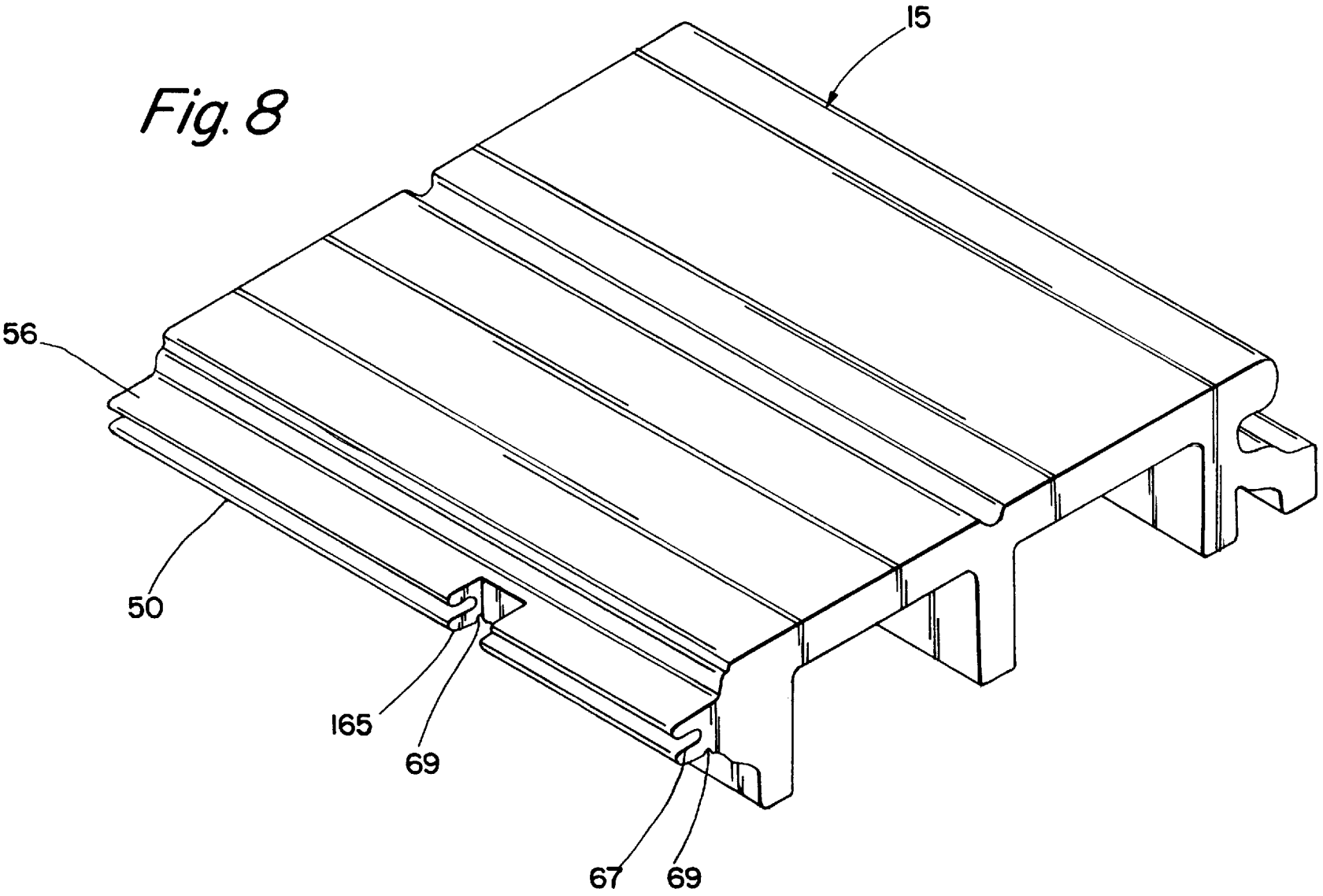
FIG. 8 is a perspective view of a preferred embodiment of a deck plank of the present invention.
Figure 9:
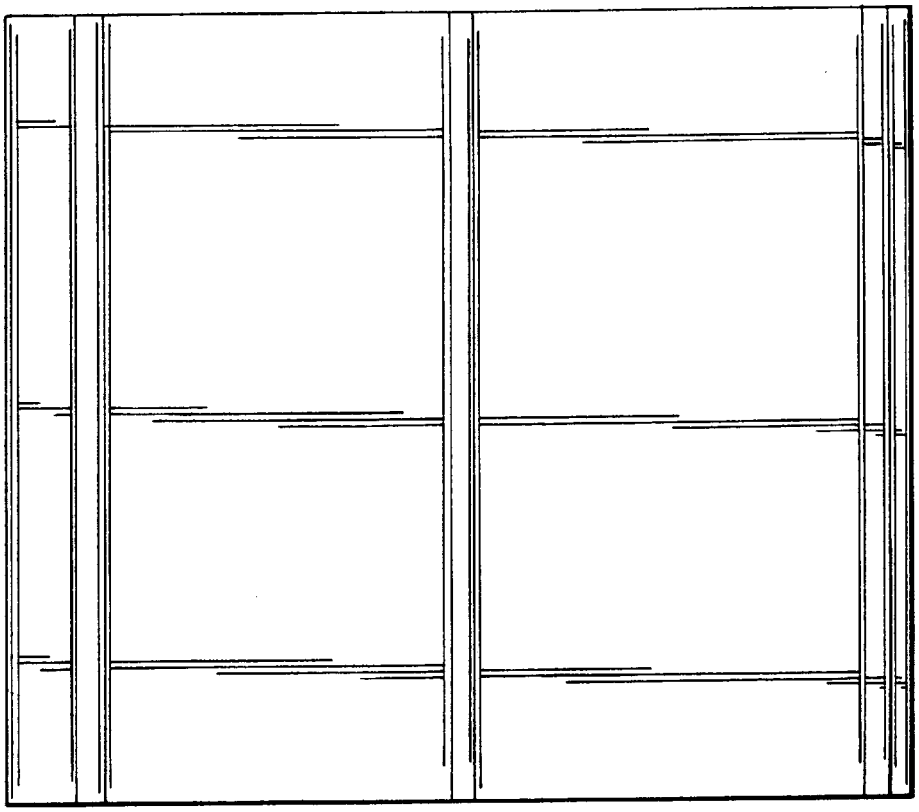
FIG. 9 is a top plan view of a preferred embodiment of a deck plank of the present invention.
Figure 10:
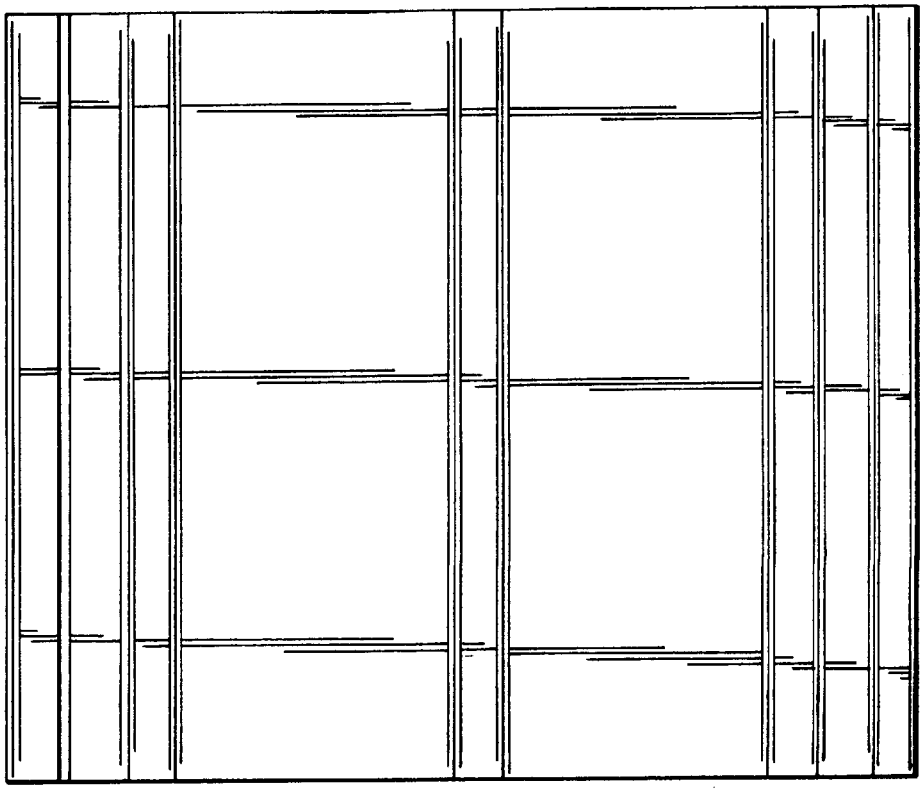
FIG. 10 is a bottom plan view of the deck plank of FIG. 9.
Figure 11:
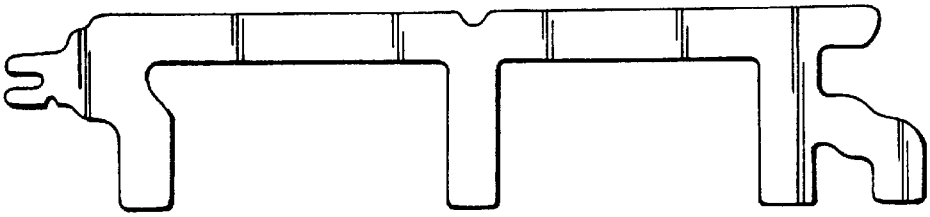
FIG. 11 is a side elevation view of the deck plank of FIG. 9.
Figure 12:
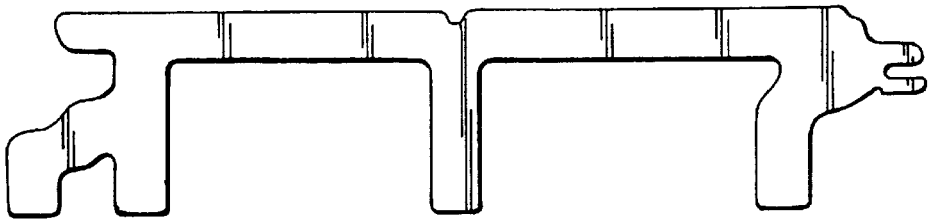
FIG. 12 is an opposite side elevation view of the deck plank of FIG. 9.
Figure 13:
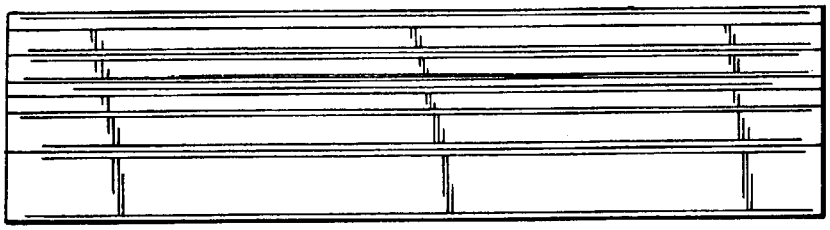
FIG. 13 is an end elevation view of the deck plank of FIG. 9.
Figure 14:
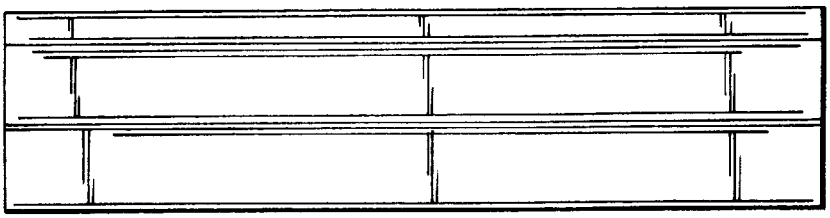
FIG. 14 is an opposite end elevation view of the deck plank of FIG. 9.

FIG. 8 is a perspective view of a preferred embodiment of a deck plank 15. In this embodiment, a channel 69 extends horizontally along the tongue 50. The tongue 50 defines a recess 67. A vertical cutout 165 extends through the outer portion 56 of the tongue 50.

FIGS. 9 through 14 need no further discussion as they are merely design drawings of a preferred embodiment of a deck plank 15.

EXAMPLE

Figure 15:
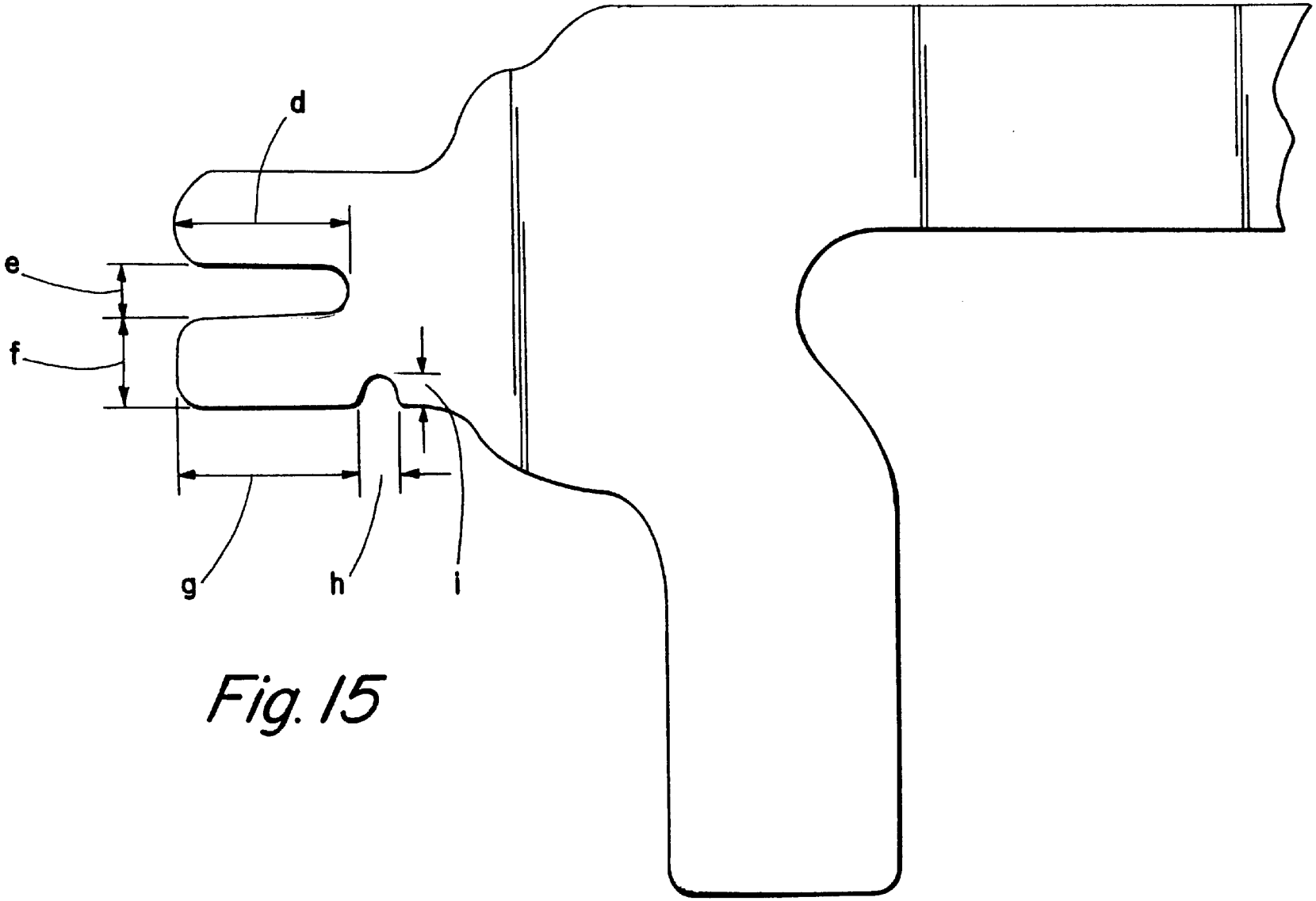
FIG. 15 is a partial side elevation view of a preferred embodiment of a deck plank of the present invention.

A deck plank was manufactured from a wood replacement material. FIG. 15 will be utilized to describe the most relevant measurements of the deck plank. As indicated by arrows d and e, the limbs of the tongue defined a recess that was 0.2364 inch deep and 0.0788 inch wide. The sacrificial limb was 0.1379 inch thick as indicated by the arrow f. Arrow g shows the distance from the substantially vertical edge of the sacrificial limb to the channel. The channel was located 0.2561 inch from the substantially vertical edge of the sacrificial limb. The channel was 0.0394 inch deep and wide as indicated by arrows h and i. The tongue of the deck plank was placed in the groove of an adjacent deck plank substantially as shown in FIG. 3. The wood replacement material of the deck planks was then expanded. As the material expanded, the channel induced the sacrificial limb to fracture. The fracture allowed the tongue to slide horizontally into the groove of the adjacent deck plank so that the joint between the deck planks did not buckle.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A deck plank comprised of a wood replacement material, said deck plank including:

a top surface having a first end portion and a second end portion;

a first leg attached to said first end portion, said first leg extending downward from said top surface, said first leg having a tongue and an outer surface, said tongue having a first limb and a second limb, said first limb and said second limb defining a recess, said outer surface defining a channel; and a second leg attached to said second end portion, said second leg extending downward from said top surface, said second leg having an upper portion and a lower portion, said upper portion and said lower portion defining a groove, said tongue being adapted to fit with a groove of an adjacent, substantially similar deck plank;

wherein, when said tongue of said deck plank is placed in said groove of said adjacent deck plank, said channel of said deck plank is adapted to induce one of said limbs to fracture, if necessary, in response to expansion of said wood replacement material so that vertical displacement of said top surface of said deck plank is limited.

2. The deck plank of claim 1 wherein said first leg and said second leg of said deck plank are adapted to maintain a gap between a portion of said first leg of said deck plank and a portion of said second leg of said adjacent deck plank when an outer portion of said tongue of said deck plank is placed adjacent to an inner portion of said groove of said adjacent deck plank.

3. The deck plank of claim 1 further comprising a third leg attached to and extending downward from said top surface at a point intermediate between said first and second end portions.

4. The deck plank of claim 1 wherein said top surface has a channel extending the length of said deck plank.

5. The deck plank of claim 1 wherein said tongue has a vertical cutout.

6. The deck plank of claim I wherein said deck plank is an extruded component.

7. The deck plank of claim 1 wherein said first leg has an upper portion above said tongue and said second leg has an upper portion above said groove, said upper portion of said first leg and said upper portion of said second leg being adapted to maintain a gap between said upper portion of said first leg of said deck plank and said upper portion of said second leg of said adjacent deck plank when an outer portion of said tongue of said deck plank is placed adjacent to an inner portion of said groove of said adjacent deck plank.

8. The deck plank of claim 1 wherein said recess extends the length of said deck plank.

9. The deck plank of claim 1 wherein said channel extends the length of said deck plank.

10. The deck plank of claim 1 wherein said wood replacement material comprises a polymer.

11. The deck plank of claim 10 wherein said polymer is selected from homopolymers and copolymers of polyethylene and homopolymers and copolymers of polyvinyl chloride and mixtures thereof.

12. The deck plank of claim 10 wherein said wood replacement material further comprises a cellulose material.

13. The deck plank of claim 12 wherein said cellulose material is wood flour.

14. The deck plank of claim 1 wherein said first leg has an angled portion of a first angle and said second leg has an angled portion of a second angle, said first angle being sufficiently different from said second angle such that said first leg and said second leg are adapted to maintain a gap between said angled portion of said first leg of said deck plank and said angled portion of said second leg of said adjacent deck plank when an outer portion of said tongue of said deck plank is placed adjacent to an inner portion of said groove of said adjacent deck plank.

15. The deck plank of claim 14 wherein said first angle is greater than said second angle.

16. The deck plank of claim 14 wherein said second angle is greater than said first angle.

17. The deck plank of claim 14 wherein said outer portion of said tongue is substantially vertical.

18. The deck plank of claim 14 wherein said inner portion of said groove is substantially vertical.

19. A deck plank comprised of a wood replacement material, said deck plank including:

a top surface having a first end portion and a second end portion;

a first leg connected to said first end portion, said first leg extending downward from said top surface, said first leg having a tongue and an outer surface, said tongue having a first limb and a second limb, said first limb and said second limb defining a recess, said outer surface defining a channel; and a second leg connected to said second end portion, said second leg extending downward from said top surface, said second leg having an upper portion and a lower portion, said upper portion and said lower portion defining a groove, said tongue being adapted to fit with a groove of an adjacent, substantially similar deck plank, said first leg and said second leg forming at least one open area beneath said top surface;

wherein, when said tongue of said deck plank is placed in said groove of said adjacent deck plank, said channel of said deck plank is adapted to induce one of said limbs to fracture, if necessary, in response to expansion of said wood replacement material so that vertical displacement of said top surface of said deck plank is limited.

20. The deck plank of claim 19 wherein said wood replacement material includes a polymer.

21. The deck plank of claim 19 wherein said wood replacement material includes a cellulose material.

22. The deck plank of claim 19 wherein said recess extends the length of said deck plank.

23. The deck plank of claim 19 wherein said channel extends the length of said deck plank.

24. The deck plank of claim 19 wherein said tongue has a vertical cutout.

25. The deck plank of claim 19 wherein said deck plank is an extruded component.

26. The deck plank of claim 19 wherein said first leg and said second leg of said deck plank are adapted to maintain a gap between a portion of said first leg of said deck plank and a portion of said second leg of said adjacent deck plank when an outer portion of said tongue of said deck plank is placed adjacent to an inner portion of said groove of said adjacent deck plank.

27. The deck plank of claim 19 further comprising a third leg attached to and extending downward from said top surface at a point intermediate between said first and second end portions.

28. The deck plank of claim 19 wherein said top surface has a channel extending the length of said deck plank.

29. The deck plank of claim 19 wherein said deck plank is adapted to be installed with at least one fastener through said lower portion of said second leg.

30. The deck plank of claim 29 wherein said fastener is a nail.

31. A deck comprising:

a support structure; and at least one deck plank comprised of a wood replacement material attached to said support structure, said deck plank including a top surface, a first leg, and a second leg, said top surface having a first end portion and a second end portion, said first leg attached to said first end portion, said first leg extending downward from said top surface, said first leg having a tongue and an outer surface, said tongue having a first limb and a second limb, said first limb and said second limb defining a recess, said outer surface defining a channel, said second leg attached to said second end portion, said second leg extending downward from said top surface, said second leg having an upper portion and a lower portion, said upper portion and said lower portion defining a groove, said tongue being adapted to fit with a groove of an adjacent, substantially similar deck plank;

wherein, when said tongue of said deck plank is placed in said groove of said adjacent deck plank, said channel of said deck plank is adapted to induce one of said limbs to fracture, if necessary, in response to expansion of said wood replacement material so that vertical displacement of said top surface of said deck plank is limited.

32. The deck of claim 31 further comprising a starter strip made from a wood replacement material, said starter strip attached to said support structure, said starter strip having a groove adapted to receive said tongue of said deck plank.

33. The deck of claim 31 wherein said recess extends the length of said deck plank.

34. The deck of claim 31 wherein said channel extends the length of said deck plank.

35. The deck of claim 31 wherein said first leg and said second leg of said deck plank are adapted to maintain a gap between a portion of said first leg of said deck plank and a portion of said second leg of said adjacent deck plank when an outer portion of said tongue of said deck plank is placed adjacent to an inner portion of said groove of said adjacent deck plank.

36. The deck of claim 35, further comprising a starter strip made from a wood replacement material, said starter strip attached to said support structure, said starter strip having a leg that defines a groove, said leg of said starter strip shaped so that a gap is maintained between said portion of said first leg of adjacent and a portion of said leg of said starter strip when an outer portion of said tongue of said adjacent deck plank is placed adjacent to an inner portion of said groove of said starter strip.

37. The deck of claim 31 wherein said first leg has an angled portion of a first angle and said second leg has an angled portion of a second angle, said first angle being sufficiently different from said second angle such that said first leg and said second leg are adapted to maintain a gap between said angled portion of said first leg of said deck plank and said angled portion of said second leg of said adjacent deck plank when an outer portion of said tongue of said deck plank is placed adjacent to an inner portion of said groove of said adjacent deck plank.

38. The deck of claim 37 further comprising a starter strip made from a wood replacement material, said starter strip attached to said support structure, said starter strip having a leg that defines a groove, said leg of said starter strip having an angled portion of a third angle, said first angle being sufficiently different from said third angle so that a gap is maintained between said angled portion of said first leg of said adjacent deck plank and said angled portion of said starter strip when an outer portion of said tongue of said adjacent deck plank is placed adjacent to an inner portion of said groove of said starter strip.

39. The deck of claim 38 wherein said first angle is greater than said third angle.

40. The deck of claim 38 wherein said first angle is less than said third angle.

41. A method of making a deck comprising:

providing a support structure;

providing a first deck plank comprised of a wood replacement material, said first deck plank including a top surface, a first leg, and a second leg, said top surface having a first end portion and a second end portion, said first leg attached to said first end portion, said first leg extending downward from said top surface, said first leg having a tongue and an outer surface, said tongue having a first limb and a second limb, said first limb and said second limb defining a recess, said outer surface defining a channel, said second leg attached to said second end portion, said second leg extending downward from said top surface, said second leg having an upper portion and a lower portion, said upper portion and said lower portion defining a groove, said tongue being adapted to fit with a groove of an adjacent, substantially similar deck plank; and attaching said first deck plank to said support structure;

wherein, when said tongue of said first deck plank is placed in said groove of said adjacent deck plank, said channel of said deck plank is adapted to induce one of said limbs to fracture, if necessary, in response to expansion of said wood replacement material so that vertical displacement of said top surface of said first deck plank is limited.

42. The method of claim 41 further comprising:

providing a second deck plank comprised of a wood replacement material said second deck plank including a top surface, a first leg, and a second leg, said top surface having a first end portion and a second end portion, said first leg attached to said first end portion, said first leg extending downward from said top surface, said first leg having a tongue and an outer surface, said tongue having a first limb and a second limb, said first limb and said second limb defining a recess, said outer surface defining a channel, said second leg attached to said second end portion, said second leg extending downward from said top surface, said second leg having an upper portion and a lower portion, said upper portion and said lower portion defining a groove, said tongue of said second deck plank adapted to fit with a groove of an adjacent, substantially similar deck plank;

placing said tongue of said second deck plank adjacent said groove of said first deck plank; and attaching said second deck plank to said support structure;

wherein, when said wood replacement material of said first deck plank and said second deck plank expands, said channel of said second deck plank is adapted to induce one of said limbs of said second deck plank to fracture, if necessary, so that vertical displacement of said top surface of said second deck plank is limited.

43. The method of claim 41 further comprising: providing a starter strip having a groove adapted to receive said tongue of said first deck plank; attaching said starter strip to said support structure; and placing said tongue of said first deck plank adjacent said groove of said starter strip.

44. The method of claim 41 wherein said recess extends the length of said first deck plank.

45. The method of claim 41 wherein said channel extends the length of said first deck plank.

46. The method of claim 41 wherein said first deck plank is adopted to be attached to said support structure by at least one fastener through said lower portion of said second leg.

* * * * *

UNITED STATES PATENT AND TRADEMARK OFFICE

CERTIFICATE OF CORRECTION

PATENT NO: 6,035,588

DATED: March 14, 2000

INVENTOR(S): Zehner, et al.

It is certified that error appears in the above-identified patent and that said Letters Patent is hereby corrected as shown below:

In column 11, line 13, before the word "adjacent", insert - said --.

In column 11, line 13, after the word "adjacent", insert - deck plank --.

In column 12, line 42, after "plank", insert a line break and drop the phrase beginning with "attaching said starter ..." down to a new line.

In column 12, line 52, delete the word "adopted" and replace it with - adapted --.

Signed and Sealed this

Thirteenth Day of March, 2001

*Attest:*

Nicholas P. Godici

NICHOLAS P. GODICI

*Attesting Officer*

*Acting Director of the United States Patent and Trademark Office*